US005112572A

United States Patent [19]

Eerkes et al.

[11] Patent Number: 5,112,572

[45] Date of Patent: May 12, 1992

[54] DEOXIDATION TREATMENT FOR CONSOLIDATED ATOMIZED METAL POWDER

[75] Inventors: Thijs Eerkes; James A. E. Bell, both of Oakville; Carlos M. Diaz, Mississauga, all of Canada

[73] Assignee: Inco Limited, Toronto, Canada

[21] Appl. No.: 769,956

[22] Filed: Oct. 1, 1991

[51] Int. Cl.[5] ..... B22F 1/00

[52] U.S. Cl. ..... 419/30; 134/3; 134/28; 134/29; 134/30; 134/91; 419/49; 419/63; 419/66

[58] Field of Search ..... 134/3, 28, 29, 91; 419/30, 63, 66, 44

[56] References Cited

U.S. PATENT DOCUMENTS 4,818,482 4/1989 Poole et al. ..... 419/33

4,960,459 10/1990 Poole et al. ..... 419/63

*Primary Examiner*—Stephen J. Lechert, Jr.

*Attorney, Agent, or Firm*—Francis J. Mulligan, Jr.; Blake T. Biederman

[57] ABSTRACT

The invention provides a method for removing the oxide surface from water atomized metal powders containing an oxidizer capable of oxidizing chromium from a trivalent to a soluble hexavalent state, whereby chromium oxides are removed from the metal powder surface. The powder is then treated with a dilute acid solution essentially devoid of hydrofluoric acid to remove other hydrated oxides from the metal powder surface. The powder is then water washed and dried.

15 Claims, 1 Drawing Sheet

DEOXIDATION TREATMENT FOR CONSOLIDATED ATOMIZED METAL POWDER

TECHNICAL FIELD

This invention is related to a method of producing formable metal powders. More particularly, this invention is related to pickling chromium containing powder to produce powder that is compactable into objects having sufficient green strength for further operations.

BACKGROUND OF ART AND PROBLEM

Pickling of metal powders is a known method of reducing surface oxides to increase formability of water atomized metal powders. However, high nickel and chromium alloys typically have required strong solutions for pickling such as salt baths, hydrofluoric acid or mixtures containing hydrofluoric acid. Previous pickling, as disclosed in U.S. Pat. No. 4,818,482 requires a first step rinse with an acid mixture of nitric acid and hydrofluoric acid. This hydrofluoric acid is hazardous, corrosive and requires special and costly safety procedures. Furthermore, neutralization and/or disposal of liquors and fume emissions are subject to very stringent control regulations. The best results were achieved by pickling with nitric and hydrofluoric acid, rinsing with water, pickling in an oxidizing alkaline bath and pickling again with nitric and hydrofluoric acid. Although effective, the above process contains several steps and relies upon undesirable hydrofluoric acid during two pickling steps of the operation.

It is an object of this invention to provide a hydrofluoric acid free method of pickling corrosion resistant powders.

It is another object of this invention to provide an effective method of removing surface oxides from metal powders.

It is another of object of this invention to provide a method of forming water atomized corrosion resistant powders into objects of sufficient green strength for further handling.

SUMMARY OF THE INVENTION

The invention provides a method for removing the oxide surface from water atomized metal powders containing chromium. The metal powder is treated with an alkaline solution containing an oxidizer capable of oxidizing chromium from a trivalent to a soluble hexavalent state, whereby chromium oxides are removed from the metal powder surface. The powder is then treated with a dilute acid solution essentially devoid of hydrofluoric acid to remove other hydrated oxides from the metal powder surface. The powder is then water washed and dried.

DESCRIPTION OF PREFERRED EMBODIMENT

Figure 1:
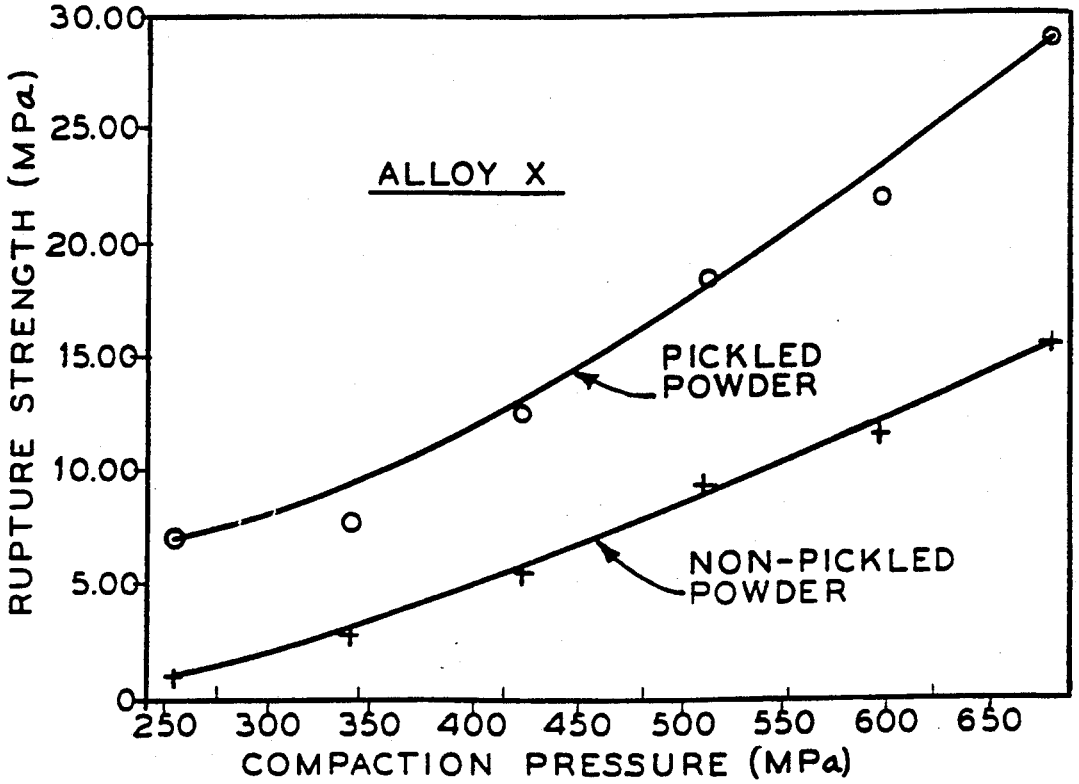
FIG. 1 is a plot illustrating green strength versus compaction pressure for pickled and non-pickled powders having a nominal composition of 33Ni-21Cr-44Fe.

The invention provides a simplified method for removing surface oxides from water atomized powders containing chromium. A relatively strong oxidizer capable of oxidizing trivalent chromium to hexavalent chromium is used in the process of the invention. The oxidizer of Example 1 below was permanganate and the oxidizer of Examples 2 and 3 below was persulfate.

EXAMPLE 1

Water atomized metal powders of two iron-nickel-chromium alloys were tested, Alloy X (INCOLOY® alloy 800) and Alloy Y (INCOLOY® alloy 825). INCOLOY is a registered trademark of the Inco family of companies. Composition of the metal powders in weight percent is listed below in Table 1.

TABLE 1

| | Ni | Cr | Fe | Cu | Mn | Mo | O | N |
|---|---|---|---|---|---|---|---|---|
| Alloy X | 33 | 21 | 44 | 0.0 | 0.76 | 0.0 | 0.17 | 0.067 |
| Alloy Y | 43 | 23 | 30 | 2.0 | 0.0 | 3.0 | 0.45 | 0.14 |

The size distributions of the metal powders are listed below in Table 2.

TABLE 2

| Size of Powder microns (μm) | Alloy X (wt %) | Alloy Y (wt %) |
|---|---|---|
| +1 | 15.5 | 2.6 |
| −150 + 75 | 83.8 | 17.2 |
| −75 + 53 | 0.5 | 15.8 |
| −53 + 45 | 0.1 | 16.2 |
| −45 + 38 | 0.04 | 10.9 |
| −38 | 0.14 | 37.3 |

The above powders were added to an alkaline permanganate solution in 2000 g portions. The alkaline permanganate solution consisted of 2100 ml water, 250 g of dissolved sodium hydroxide, and 125 g of potassium permanganate ($KMnO_4$). Advantageously, pH of the alkaline solution is maintained at a level of at least 12 and most advantageously at a level of at least 13. The alkaline permanganate solution was heated to 85° C. prior to addition of the powder. The mixture was agitated for one hour while temperature was maintained at about 85° C. Agitation was utilized to ensure contact between the alkaline permanganate solution and the metal powder. Advantageously, an alkaline solution having a temperature range between about 70° C. and 100° C. is used to achieve an acceptable rate of chromium dissolution. Most advantageously, a temperature of about 80° C. to 90° C. is used for decreasing times of reaction. The slurry was filtered, the solids were rinsed with water. The powder compositions in weight percent after this initial pickling treatment are listed below in Table 3.

TABLE 3

| | Ni | Cr | Fe | Mn | O | % Cr dissolved |
|---|---|---|---|---|---|---|
| Alloy X | 33 | 21 | 44 | 0.76 | 0.12 | 0.33 |
| Alloy Y | 41 | 21 | 29 | 0.87 | 1.32 | 2.3 |

The alkaline permanganate treatment was followed by an acid treatment for removal of the precipitated manganese oxide. The acid treatment also effectively removes iron, nickel, and a small amount of chromium to clean the surface of the metal powder. 300 g each of the above products were stirred into an acidic solution essentially devoid of hydrofluoric acid. The solution consisted of 300 ml of water and 9.1 ml of concentrated sulfuric acid heated and maintained at a temperature of 85° C. Advantageously, an acid treatment at temperatures of about 70° C. to 100° C. is used to expedite the acid treatment. Most advantageously, the acid treatment is at a temperature between 80° C. and 90° C. The invention has also been found to operate effectively with hydrochloric acid and nitric acid. A pH of only about 2 or less was required to provide for the dissolution of additional metals. Advantageously, pH of an acid treatment is maintained at a level between about 1 and 4 to effectively dissolve metal hydroxides. Typical acid concentrations are below 1 mole per liter and greater than 0.55 moles per liter. In the case of sulfuric acid this is equivalent to only about 50 g of acid per liter of water. From an industrial standpoint this acid concentration is dilute. The use of a dilute acids such as acetic, hydrochloric, sulfuric or nitric provides several commercial advantages. The acids are less corrosive, less hazardous and less expensive to neutralize and dispose of than hydrofluoric acid. The solution was agitated for 60 minutes, filtered, washed and dried. Agitation was used to provide complete surface contact between the metal powder and the acid solution. The metal powder was dried with alcohol. Advantageously, commercial products would be dried with a vacuum procedure. After the acid treatment, analysis of the metal powder in weight percent is listed below in Table 4.

TABLE 4

| | Ni | Cr | Fe | Mn | O |
|---|---|---|---|---|---|
| Alloy X | 33 | 21 | 44 | 0.72 | 0.04 |
| Alloy Y | 41 | 21 | 29 | 0.05 | 0.13 |

Pickled and non-pickled powders were then compacted into 2.58 cm diameter tablets at various pressures. The samples were first tested for density followed by a test for green strength. Green strength was measured by using a three point rupture test. The three point procedure for testing standard green strength utilized a method for green strength for compacted metal powder specimens (ASTM B312-82). Compacting the metal powder was completed without the use of binders or lubricants. Testing results for the sample are listed below in Table 5.

TABLE 5

| Compaction Pressure (MPa) | Alloy X Density (g/cc) As is | Alloy X Density (g/cc) Pickled | Alloy X Strength (MPa) As is | Alloy X Strength (MPa) Pickled | Alloy Y Density (g/cc) As is | Alloy Y Density (g/cc) Pickled | Alloy Y Strength (MPa) As is | Alloy Y Strength (MPa) Pickled |
|---|---|---|---|---|---|---|---|---|
| 255 | 5.2 | 5.3 | 1.0 | 7.1 | 5.2 | 5.2 | 2.9 | 7.7 |
| 341 | 5.6 | 5.5 | 2.8 | 7.8 | 5.5 | 5.6 | 7.1 | 13.9 |
| 425 | 5.9 | 5.7 | 5.6 | 12.7 | 5.8 | 5.8 | 10.8 | 19.7 |
| 511 | 6.0 | 6.1 | 9.5 | 18.5 | 6.0 | 6.1 | 15.6 | 26.4 |
| 596 | 6.2 | 6.2 | 11.8 | 22.0 | 6.3 | 6.4 | 20.1 | 38.9 |
| 680 | 6.2 | 6.3 | 15.6 | 29.0 | 6.4 | 6.5 | 23.9 | 42.2 |

Figure 2:
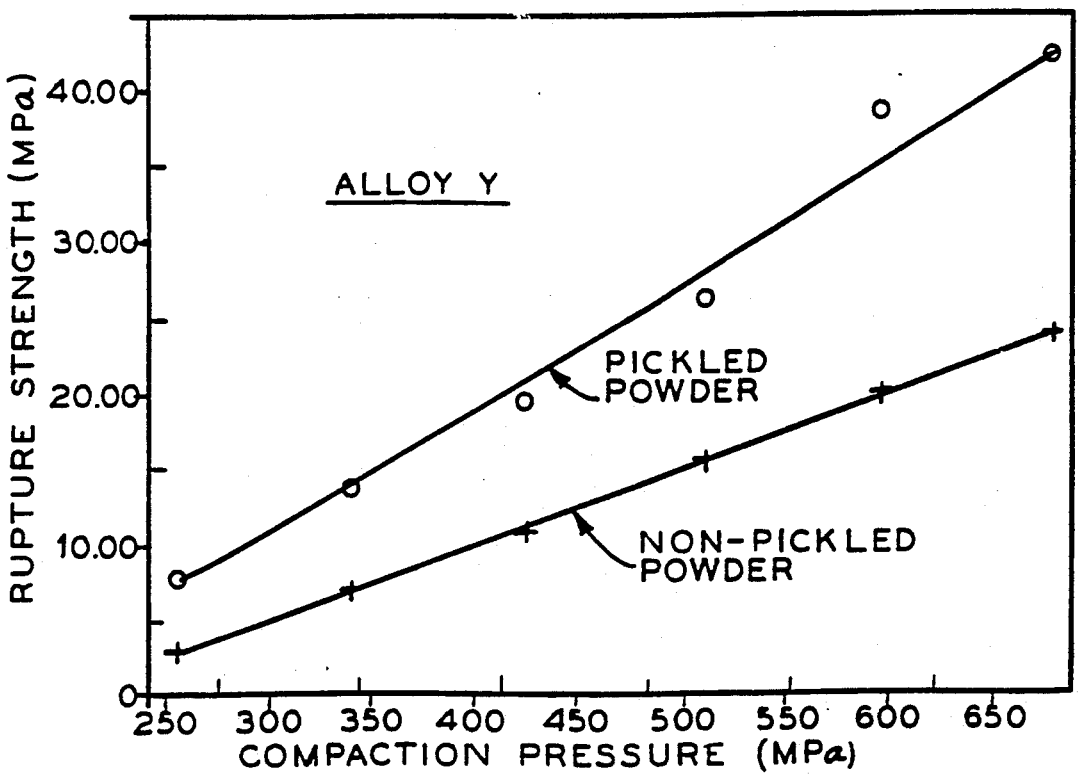
FIG. 2 is a plot illustrating green strength versus compaction pressure for pickled and non-pickled powders having a nominal composition of 43Ni-23Cr-30Fe.

As recorded in Table 5 and illustrated in FIGS. 1 and 2, the pickling method of the invention increases the tablet green strength approximately 100% over the entire pressure range. The pickling does not seem to affect tablet density. The process of the invention appears to produce a readily formable powder that may be compressed into objects of various shapes without the use of binders or lubricants.

Direct rolling at ambient temperature of these unpickled powders into strip was not found to be possible. However, pickled powders were readily cold rolled without the use of binders. High quality green strip with densities of 5.54 and 5.14 g/cc respectively were obtained for the Alloy X and Y powders after initial rolling. All cold rolling was conducted at ambient temperature. These strips were then sintered in pure hydrogen at 1200° C. for 1 hour and cold rolled. An atmosphere substantially free of nitrogen and oxygen was used to prevent pick up of these gases by chromium. Most advantageously, an atmosphere substantially free of nitrogen and oxygen is used. Sintering and cold rolling was repeated twice to yield flexible strips of the following densities and gas contents listed below in Table 6.

TABLE 6

| | Density (g/cc) | O (wt %) | N (wt %) |
|---|---|---|---|
| Alloy X | 7.67 | 0.027 | 0.0021 |
| Alloy Y | 7.77 | 0.044 | 0.0016 |

Typical densities for Alloy X and Y are 7.94 and 8.14 g/cc respectively. The Alloy X and Y powders were therefore compressed to about 95% and 97% of theoretical density respectively. This demonstrates the ability of powders formed by this invention to be readily formed into useful products.

Results presented in Table 7 below indicate that the $NaOH-KMnO_4$ treatment step requires less than one hour. In this test Alloy X powder was agitated at 85° C. Both solids and liquids were sampled every 15 minutes and analyzed.

TABLE 7

| Time minutes | Powder Analyses (wt. %) Ni | Fe | Cr | Mn | O | Solution, Analyses (gpl) Chromium |
|---|---|---|---|---|---|---|
| 0 | 32.7 | 44.4 | 21.0 | 0.76 | 0.17 | 0.0 |
| 15 | 32.4 | 43.1 | 20.5 | 0.72 | 0.16 | 0.40 |
| 30 | 32.1 | 42.6 | 20.2 | 0.72 | 0.14 | 0.52 |
| 45 | 32.2 | 42.8 | 20.0 | 0.73 | 0.15 | 0.59 |
| 60 | 32.2 | 42.8 | 20.2 | 0.73 | 0.13 | 0.59 |

The final powder product from the above test was filtered off, water washed and then 1500 grams were agitated in 2010 ml of sulfuric acid (57.7 gpl) solution at 85° C. Results presented below in Table 8 indicate that less than 15 minutes was required to lower the oxygen to 0.02–0.03%.

TABLE 8

| Time minutes | Powder Analyses (wt. %) Ni | Fe | Cr | Mn | O | Solution, Analyses (gpl) Ni | Fe | Cr | Mn |
|---|---|---|---|---|---|---|---|---|---|
| 0 | 32.2 | 42.8 | 20.2 | 0.73 | 0.17 | 0 | 0 | 0 | 0 |
| 15 | 32.2 | 44.3 | 20.7 | 0.73 | 0.023 | 0.31 | 0.41 | 0.04 | 0.17 |
| 30 | 33.3 | 44.5 | 21.0 | 0.73 | 0.026 | 0.36 | 0.46 | 0.06 | 0.18 |

In another study, the effect of temperature of the two pickling steps on deoxidation was studied at 75°–95° C. As before, 2000 g of Alloy Y powder was added to 2100 ml of water containing 250 g of NaOH and 125 g of $KMnO_4$ and stirred for one hour at the indicated temperature. After filtering and washing, 200 g of each product was treated with dilute sulfuric acid at 75°, 85° or 95° C. for one hour. Oxygen analyses of the final products listed below in Table 9 indicate that increasing the temperatures in both stages yields lower oxygen products.

TABLE 9

| | Final oxygen in wt. % |
|---|---|
| NaOH $KMnO_4$ Treatment at 75° C. | |
| Acid pickling at: 75° C. | 0.20 |
| 85° C. | 0.14 |
| 95° C. | 0.14 |
| NaOH-$KMnO_4$ Treatment at 85° C. | |
| Acid pickling at: 75° C. | 0.19 |
| 85° C. | 0.17 |
| 95° C. | 0.15 |
| NaOH-$KMnO_4$ Treatment at 95° C. | |
| Acid pickling at: 75° C. | 0.23 |
| 85° C. | 0.16 |
| 95° C. | 0.11 |

The acid solution temperature range of 75° C. to 95° C. was found to perform satisfactorily. Most preferably, a temperature of at least about 85° C. is utilized.

Examples 2 and 3 below demonstrate the utility of using a persulfate oxidizer on different chromium-containing alloys. Example 2 uses powder of nickel-base Incoloy alloy 800 and Example 3 uses powder of 316 stainless steel.

EXAMPLE 2

A sample of alloy X powder (Incoloy alloy 800) containing 0.18% oxygen was treated as follows:

| | |
|---|---|
| 2000 g powder agitated in: | 3000 ml water<br>300 g NaOH<br>100 g Potassium persulfate ($K_2S_2O_8$) |

Stirred for one hour at 85° C. and filtered and washed.

The alkaline solution was then used to treat a second batch of 2000 g of powder at 85° C. for one hour; additional $K_2S_2O_8$ was introduced to maintain a redox value of +350 mv. Preferably, a redox potential of at least +300 mv is maintained sufficient to oxidize trivalent chromium to hexavalent chromium. The two powder batches were then combined and treated with dilute sulfuric acid at pH 1.5 for one hour at 85° C. Results of green strength after compacting at various pressures is given below in Table 10.

TABLE 10

| | Before Pickling | After Pickling |
|---|---|---|
| Weight % Oxygen | 0.18 | 0.13 |
| | Green Strength (MPa) | Green Strength (MPa) |
| Compacted at: | | |
| 327 MPa | 5.8 | 5.6 |
| 511 MPa | 6.8 | 12.3 |
| 676 MPa | 11.7 | 19.6 |

Table 10 illustrates that other oxidizers may be equally effective at oxidizing chromium. Specific examples of oxidizer capable of oxidizing trivalent chromium include permanganates, persulfates and ozone. Most advantageously, oxidizers would by selected upon the basis of economics and environmental impact. Persulfate appears to be the most advantageous oxidizer.

EXAMPLE 3

It has been found that other alloy powders containing chromium, such as stainless steels, can benefit from a pickling treatment. Two thousand grams of water atomized 316 stainless steel powder containing 0.23% oxygen were treated in the same manner as the Incoloy alloy 800 powder in the previous example. After washing and drying, the product contained 0.13% oxygen. Compactibility tests showed a similar improvement in the three point strength of green compacts:

| | Green Strength in MPa | |
|---|---|---|
| | Before Pickling | After Pickling |
| Compacted at | | |
| 327 MPa | 4.5 | 6.5 |
| 511 MPa | 8.8 | 10.6 |
| 676 MPa | 15.2 | 25.7 |

The process of the invention eliminates the use of first step acidic pickling process completely, eliminating the use of undesirable hydrofluoric acid in this step. Furthermore, the invention eliminates the use of hydrofluoric acid after alkaline treatment. With the process of the invention, utilization of less expensive water atomized metal powder rather than more expensive gas atomized formed powders is facilitated. It is recognized that the pickling process of the invention does not completely eliminate all oxygen, but the process reduces amounts of surface oxides or changes the nature of the oxides. The pickling process of the invention has been found to promote increased green strength in mechanically formed chromium containing powders. In addition, the process of the invention produces a powder which may be cold rolled into strip without the use of a binder. Overall, the invention provides a more efficient, fluorine free method of pickling chromium containing metal powders to prepare the metals for cold compaction.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A method for producing metal products from chromium containing metal powder having an oxidized surface comprising the steps of:

a) treating said metal powder with an alkaline solution containing an oxidizer capable of oxidizing chromium to a hexavalent state to dissolve chromium oxides from said oxidized surface of said metal powder, b) treating said metal powder with an acidic solution essentially devoid of hydrofluoric acid to remove remaining oxides from said oxidized surface of said metal powder, c) rinsing said metal powder, d) drying said metal powder, and e) consolidating said metal powder into a desired shape.

2. The method of claim 1 additionally including the step of:

f) annealing said consolidated metal powder in a reducing atmosphere.

3. The method of claim 2 wherein said metal powder is annealed in an atmosphere devoid of nitrogen and oxygen.

4. The method of claim 1 wherein said oxidizer is selected from the group consisting of permanganates, persulfates and ozone.

5. The method of claim 1 wherein said acid solution has a molarity less than one.

6. The method of claim 1 wherein said metal powder is rinsed prior to step b).

7. The method of claim 1 wherein said rinsing of said metal powder of step c) is performed with water.

8. The method of claim 1 wherein said metal powder is filter separated prior to rinsing.

9. A method for producing metal product from water atomized chromium containing metal powder having an oxidized surface comprising the steps of:

a) treating said metal powder with an alkaline solution containing sodium hydroxide and an oxidizer selected from the group consisting of permanganates, persulfates and ozone capable of oxidizing chromium to a hexavalent state to dissolve chromium oxides from said oxidized surface of said metal powder, b) rinsing said metal powder, c) treating said metal powder with an acidic solution essentially devoid of hydrofluoric acid to remove remaining surface oxides from said oxidized surface of said metal powder, d) rinsing said metal powder, e) drying said metal powder, and f) consolidating said metal powder into a desired shape.

10. The method of claim 9 wherein said acidic solution includes an acid selected from the group consisting of acetic acid, hydrochloric acid, nitric acid and sulfuric acid.

11. The method of claim 9 wherein said metal powder is rinsed with water in steps b) and d).

12. The method of claim 9 wherein said step a) additionally includes agitating said alkaline solution and said step c) additionally includes agitating said acidic solution.

13. The method of claim 9 wherein said metal powder is treated in steps a) and c) at temperatures between about 70° C. and 100° C.

14. The method of claim 9 wherein said metal powder is treated in step a) at a pH of at least about 12 and said metal powder is treated in step b) at a pH of about 1 to 4.

15. The method of claim 9 wherein said treating step a) includes maintaining a redox potential of at least +300 mv.

* * * * *